US011801523B2

(12) United States Patent
Poppe et al.

(10) Patent No.: US 11,801,523 B2
(45) Date of Patent: Oct. 31, 2023

(54) FLUID DISPENSING GUN AND METHOD FOR DISPENSING 1K-POLYURETHANE FOAM

(71) Applicant: Altachem NV, Harelbeke (BE)

(72) Inventors: Jean-Marie Poppe, Heule (BE); Wouter Halfmaerten, Bruges (BE)

(73) Assignee: ALTACHEM NV, Harelbeke (BE)

( * ) Notice: Subject to any disclaimer, the term of this patent is extended or adjusted under 35 U.S.C. 154(b) by 687 days.

(21) Appl. No.: 16/971,777

(22) PCT Filed: Mar. 15, 2019

(86) PCT No.: PCT/EP2019/056618
§ 371 (c)(1),
(2) Date: Aug. 21, 2020

(87) PCT Pub. No.: WO2019/175423
PCT Pub. Date: Sep. 19, 2019

(65) Prior Publication Data

US 2021/0086212 A1 Mar. 25, 2021

(30) Foreign Application Priority Data

Mar. 16, 2018 (BE) ..... 2018/5167

(51) Int. Cl.
*B05B 9/08* (2006.01)
*B05B 12/14* (2006.01)
*B05B 12/00* (2018.01)

(52) U.S. Cl.
CPC ..... *B05B 9/0894* (2013.01); *B05B 9/085* (2013.01); *B05B 9/0833* (2013.01);
(Continued)

(58) Field of Classification Search
CPC ..... B05B 9/0894; B05B 9/0833; B05B 9/085; B05B 12/1409; B05B 12/1418;
(Continued)

(56) References Cited

U.S. PATENT DOCUMENTS 3,541,023 A * 11/1970 Austin ..... B01F 33/50114 366/604
4,955,544 A * 9/1990 Kopp ..... B29B 7/7438 239/304

(Continued)

FOREIGN PATENT DOCUMENTS

| | | | |
|---|---|---|---|
| EP | 2 808 088 | A1 | 12/2014 |
| WO | 98/30373 | A1 | 7/1998 |
| WO | 2005/009628 | A2 | 2/2005 |

OTHER PUBLICATIONS

International Search Report in PCT/EP2019/056618, dated May 28, 2019.

*Primary Examiner* — Vishal Pancholi
(74) *Attorney, Agent, or Firm* — Collard & Roe, P.C.

(57) ABSTRACT

A fluid dispensing gun for 1K-polyurethane foam includes a dispensing tube with a dosing nozzle at its outlet, a spring-loaded needle co-axially moveable in the dispensing tube for opening and closing the dosing nozzle, a trigger actuating the needle to open the nozzle and to dispense the fluid, a regulator regulating the degree of opening of the nozzle outlet and a coupler coupling a pressurized can to the gun. It also concerns a method for dispensing 1K-polyurethane foam. The fluid dispensing gun includes a delivery device delivering a curing fluid essentially parallel to the nozzle outlet that includes a curing fluid reservoir, a curing fluid outlet situated near the nozzle and a curing fluid line connecting the curing fluid reservoir and the curing fluid outlet, the trigger activating the delivery device. The curing fluid delivered in the same direction as the 1K-polyurethane
(Continued)

Figure 1:
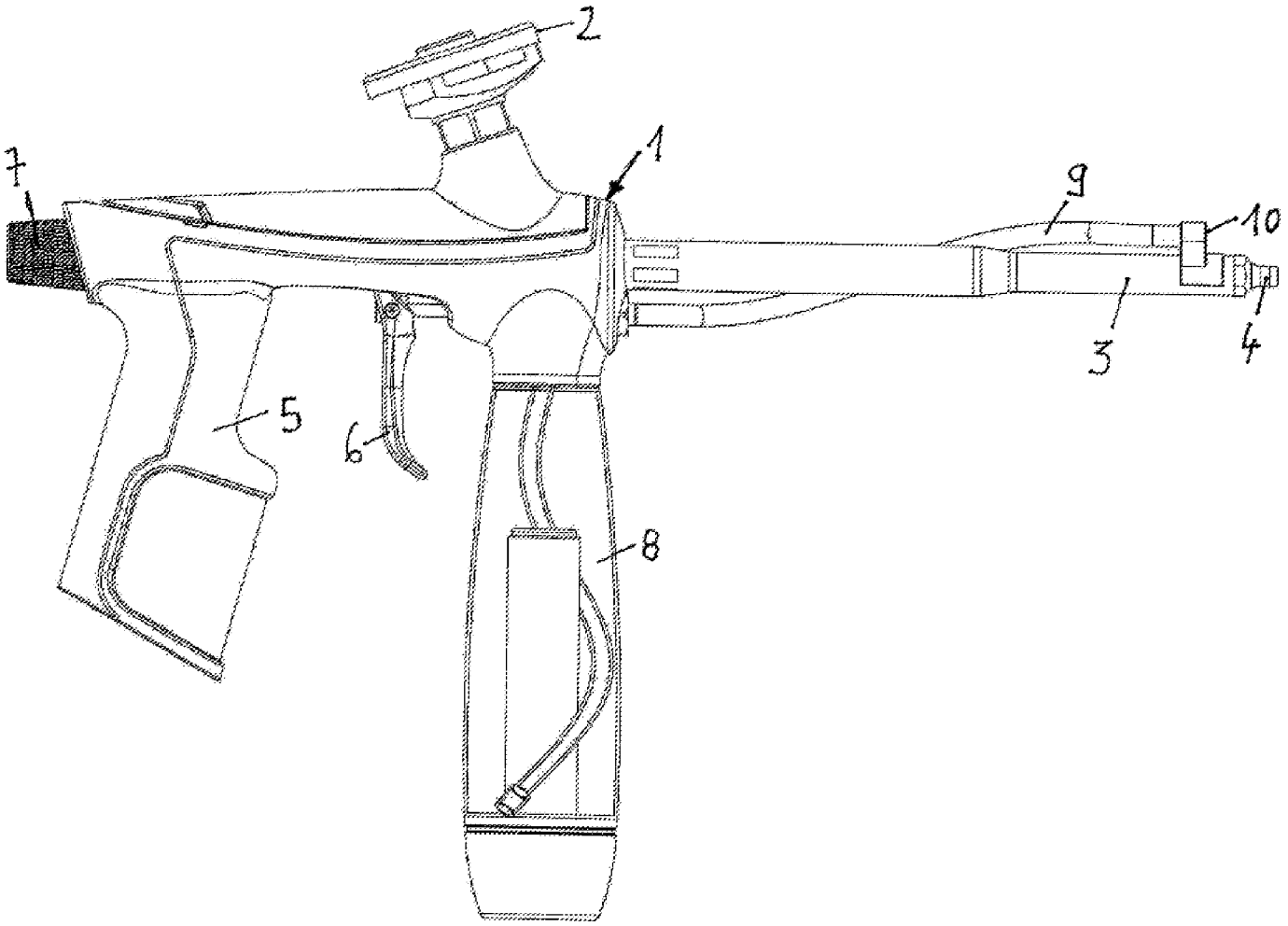

foam and separately therefrom makes the foam cure more rapidly.

14 Claims, 5 Drawing Sheets

(52) U.S. Cl.
CPC ..... *B05B 12/1409* (2013.01); *B05B 12/1418* (2013.01); *B05B 12/002* (2013.01)

(58) Field of Classification Search
CPC ..... B05B 12/002; B05B 15/63; B65D 83/682; B65D 83/207
See application file for complete search history.

(56) References Cited

U.S. PATENT DOCUMENTS 5,566,860 A * 10/1996 Schiltz ..... B05C 17/00513 222/137
6,189,735 B1 * 2/2001 Plasmati-Luchinger ..... B65D 83/207 222/394
8,844,775 B2 * 9/2014 Demey ..... B05B 1/3073 222/402.1
2015/0360849 A1 * 12/2015 Poppe ..... B05B 1/3046 222/153.11

* cited by examiner

FLUID DISPENSING GUN AND METHOD FOR DISPENSING 1K-POLYURETHANE FOAM

CROSS REFERENCE TO RELATED APPLICATIONS

This application is the National Stage of PCT/EP2019/056618 filed on Mar. 15, 2019, which claims priority under 35 U.S.C. § 119 of Belgium Application No. 2018/5167 filed on Mar. 16, 2018, the disclosure of which is incorporated by reference. The international application under PCT article 21(2) was published in English.

The invention concerns a fluid dispensing gun for 1K-polyurethane foam comprising a dispensing tube with a dosing nozzle at its outlet, a spring-loaded needle which is co-axially moveable in the dispensing tube for opening and closing the dosing nozzle, a trigger for actuating said needle in order to open the dosing nozzle and to dispense the fluid, regulating means for regulating the degree of opening of the outlet of the dosing nozzle and coupling means for coupling a pressurized can to the gun. It also concerns a method for dispensing 1K-polyurethane foam.

A foam gun of this kind is described in EP 2 808 088 A1.

Such fluid dispensing guns are used for dispensing foam, in particular polyurethane foam. There is 1-K (one component) polyurethane foam that hardens under the influence of humidity contained in the air and 2-K polyurethane foam in which two components react together in order to form hardening polyurethane foam.

WO 98/30373 A1 describes a polymeric substance delivery method and device in which the outflow is determined from a first container of a monomeric substance able to polymerize autonomously upon air contact, and eventually, the outflow from a second container is determined of a hardening substance able to accelerate the polymerization of the monomeric substance, by sending the same hardening substance towards a mixing zone of the hardening substance with the same monomeric substance. The monomeric substance and the hardening substance are mixed in the mixing zone which is situated in the device and flow out of the device immediately after mixing.

WO 2005/009628 A2 describes a delivery device forming a handle, for in-situ PU foam with two or more receiver mountings for a can, such as an in-situ PUR foam can and a can of further substances and at least one delivery tube, connected to the delivery device, whereby the substances from at least two cans may be applied by the same delivery tube.

The object of the invention is to shorten the hardening time of 1-K polyurethane foam dispensed by a fluid dispensing gun.

According to the present invention, this object is achieved in that the fluid dispensing gun comprises means for delivering a curing fluid separately from the 1K-polyurethane foam in a direction which is essentially parallel to that of the outlet of the dosing nozzle of the dispensing tube, the means for delivering a curing fluid comprising a curing fluid reservoir, a curing fluid outlet situated in proximity of the dosing nozzle of the dispensing tube and a curing fluid line connecting the curing fluid reservoir and the curing fluid outlet, the means for delivering a curing fluid being activated via the trigger of the fluid dispensing gun.

When activating the trigger of the fluid dispensing gun, the means for delivering curing fluid are activated so that the fluid dispensing gun delivers both 1K-polyurethane foam and a curing fluid (which can be water or another fluid capable to cure 1K polyurethane) which are put out separately in essentially the same direction. The curing fluid makes the polyurethane foam cure more rapidly than with the sole humidity contained in the air. Thus, the 1K polyurethane foam cures like a 2K-polyurethane foam and cellularity and the Lambda (A) values are improved compared to current 1K-polyurethane foams.

According to an embodiment of the invention, the curing fluid reservoir is a pressurized reservoir on the fluid dispensing gun provided with a valve for delivering the curing fluid from the curing fluid reservoir to the curing fluid outlet.

According to an alternative embodiment of the invention, the curing fluid reservoir is a non-pressurized reservoir on the fluid dispensing gun that comprises a pump for pumping the curing fluid from the curing fluid reservoir via the curing fluid line to the curing fluid outlet.

The curing fluid reservoir is preferably arranged on the lower side of the fluid dispensing gun.

The curing fluid reservoir may be arranged in front of the trigger, e.g. in a hollow second handle of the fluid dispensing gun.

Alternatively, the curing fluid reservoir is arranged on the upper side of the fluid dispensing gun.

The curing fluid reservoir may for instance be arranged behind the can containing 1-K polyurethane foam.

Preferably, the curing fluid reservoir is at least partly transparent.

This allows checking the curing fluid level in the curing fluid reservoir. The curing fluid reservoir can also be completely transparent.

According to an embodiment of the invention, the curing fluid outlet is designed as a spray nozzle.

This feature in connection to a sufficient pressure of the curing fluid allows delivering a spray of curing fluid in the area around the outlet of the fluid dispensing gun so that the 1K-polyurethane foam dispensed via the outlet cures quickly.

According to a further embodiment of the invention, control means are provided for starting the curing fluid delivery upon activation of the trigger of the dispensing gun.

These control means allow defining whether the curing fluid leaves the outlet before the 1-K polyurethane, at the same time as the 1-K polyurethane or after the 1-K polyurethane.

The object of the invention is also achieved by a method for dispensing 1K-polyurethane foam with a fluid dispensing gun according to the present invention, characterized in that curing fluid is delivered via a separate fluid line in an essentially parallel direction of the outlet of the dosing nozzle of the dispensing tube of the fluid dispensing gun upon activation of the trigger of the fluid dispensing gun.

According to an embodiment of the invention, the curing fluid is delivered in form of a spray.

According to a further embodiment of the invention, the curing fluid delivery starts before the delivery of the 1K-polyurethane foam.

According to another embodiment of the invention, the curing fluid delivery starts at the same time as the delivery of the 1K-polyurethane foam.

According to a further embodiment of the invention, the curing fluid delivery starts after the delivery of the 1K-polyurethane foam.

Figure 2:
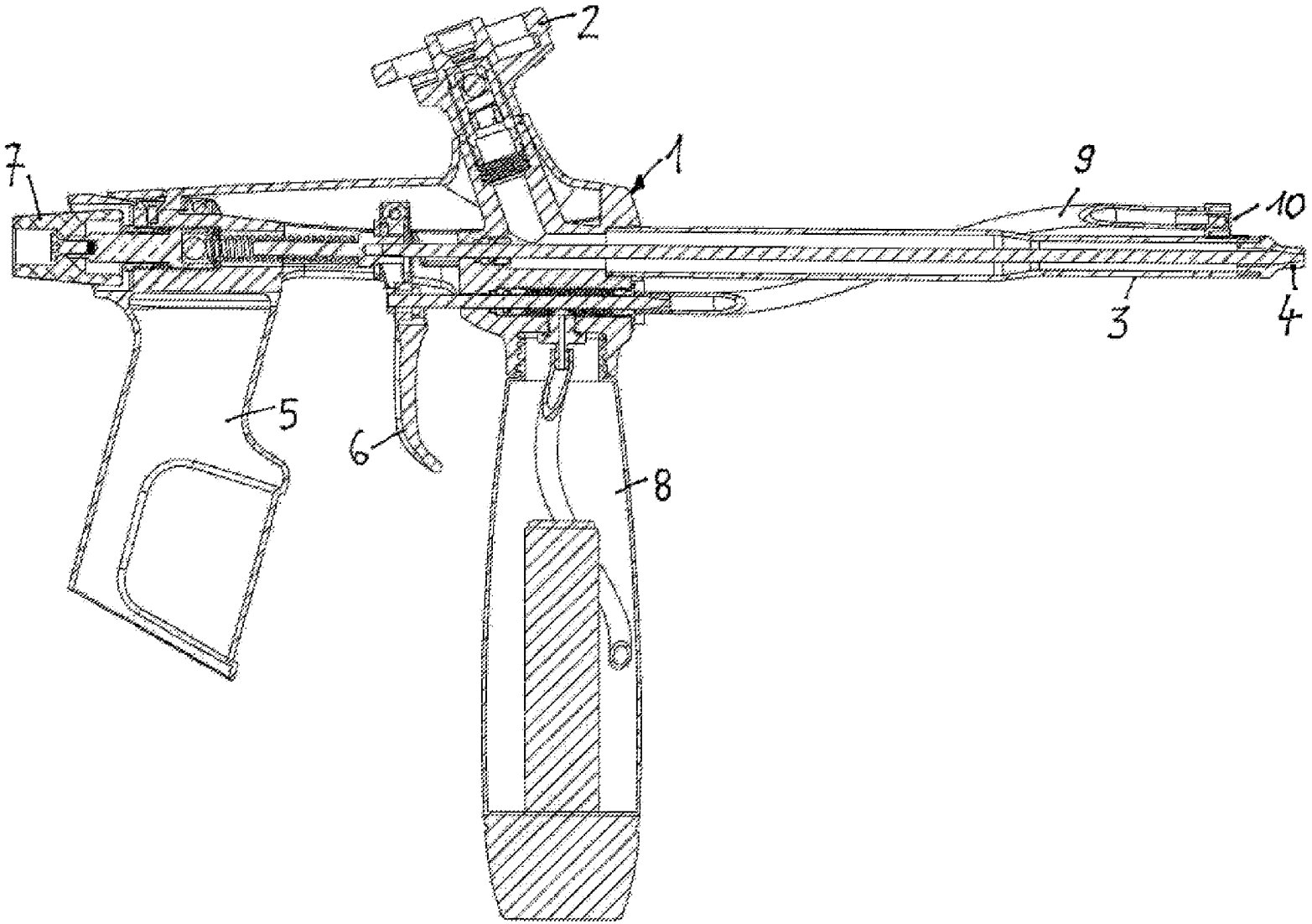
Figure 3:
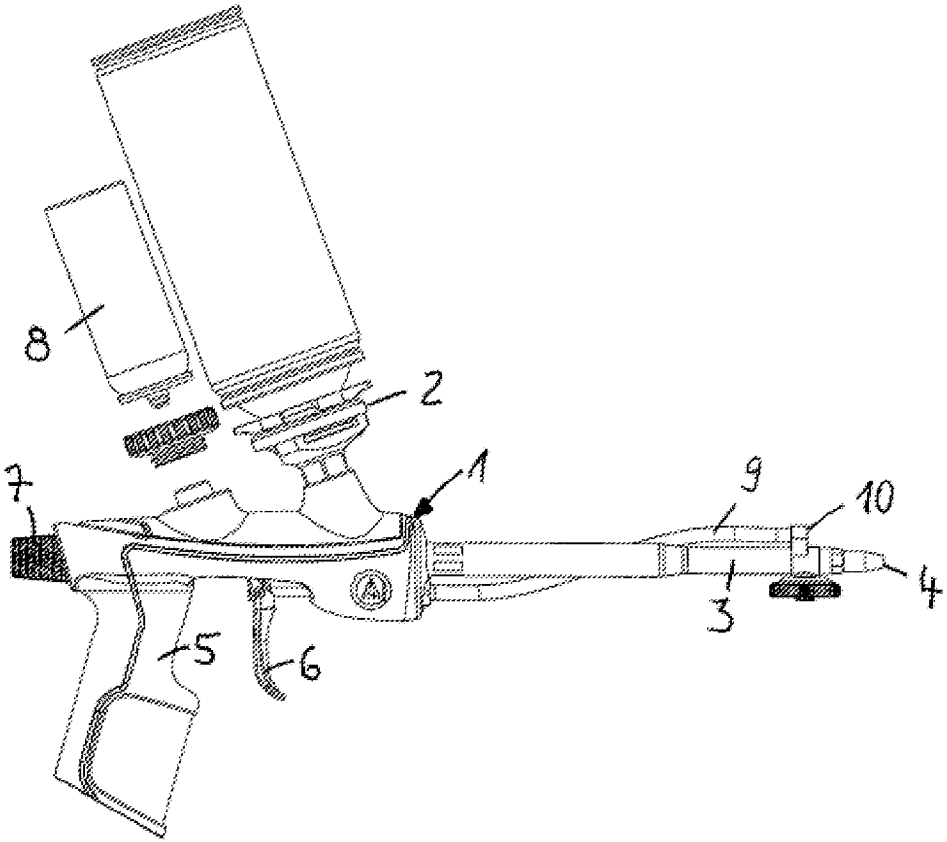
Figure 4:
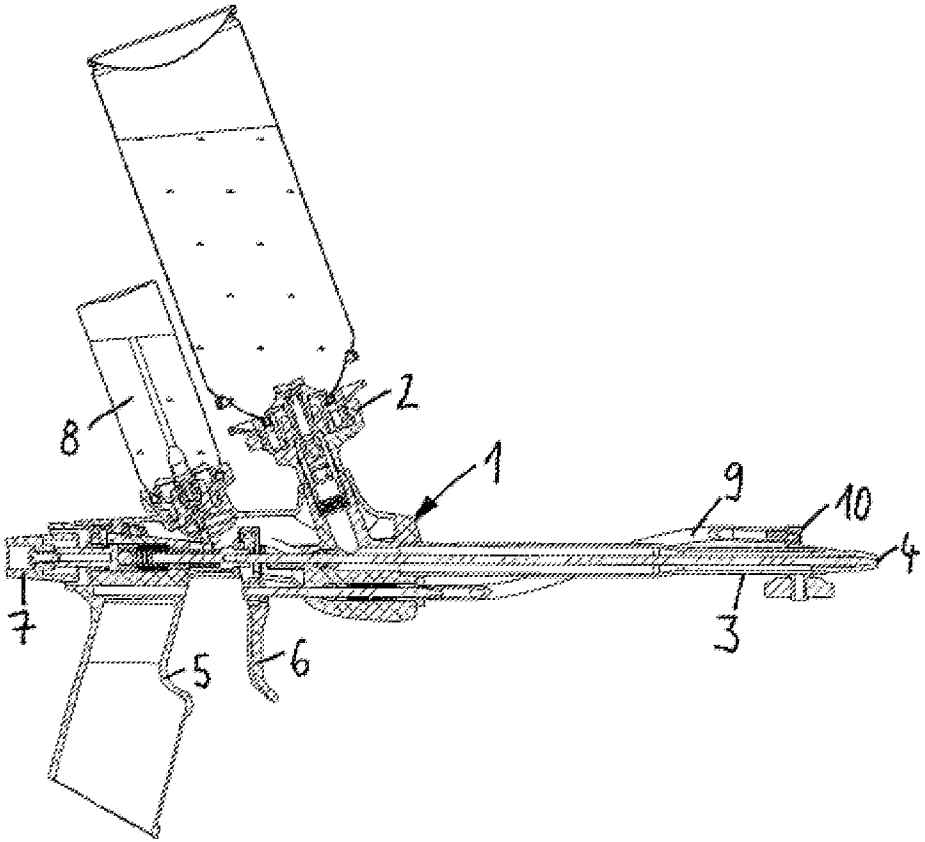
Figure 5:
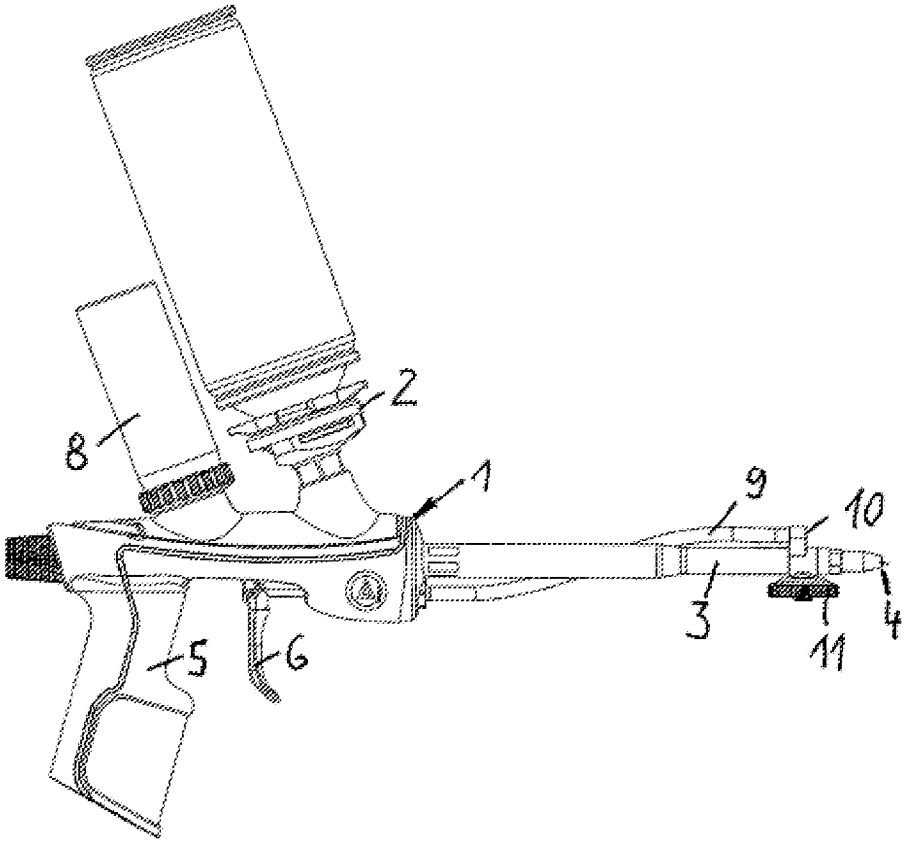

In the following, a preferred embodiment of the invention is described with reference to the figures wherein FIG. 1 shows a side view of a first fluid dispensing gun according to the invention, FIG. 2 shows a longitudinal cut through the fluid dispensing gun according to FIG. 1, FIG. 3 shows a side view of a second fluid dispensing gun according to the invention with the curing fluid reservoir in an unmounted state, FIG. 4 shows a longitudinal cut of the fluid dispensing gun according to FIG. 3 with the curing fluid reservoir in an unmounted state, FIG. 5 shows a side view of a second fluid dispensing gun according to the invention with the curing fluid reservoir in a mounted state.

The fluid dispensing gun according to the invention comprises a housing 1 on the upper side of which coupling means 2 for coupling a pressurized can to the gun are arranged.

The means 2 for coupling a pressurized can are connected via a fluid line to a dispensing tube 3 with a dosing nozzle 4 at its outlet. A spring-loaded needle is co-axially moveable in the dispensing tube 3 for opening and closing the dosing nozzle 4.

There is a handle 5 for holding the gun during operation. The user can actuate said needle by pushing on a trigger 6 situated on the lower side of the housing 1 in front of the handle. By actuating the needle, he opens the dosing nozzle 4 in order to dispense the fluid.

At the free end of the fluid dispensing gun opposed to the dosing nozzle 4, regulating means 7 for regulating the degree of opening of the outlet of the dosing nozzle are provided. By turning these regulating means, the degree of opening of the outlet is modified.

The fluid dispensing gun according to the present invention comprises means 8, 9, 10 for delivering curing fluid to a curing fluid outlet 10 situated in proximity of the outlet of the dispensing tube 3. These means comprise a curing fluid reservoir 8, a curing fluid outlet 10 situated in proximity of the outlet of the dispensing tube 3 and a curing fluid line 9 connecting the curing fluid reservoir 8 and the curing fluid outlet 10. The curing fluid is transported and delivered separately from the 1-K polyurethane so that no mixing thereof occurs in the fluid dispensing gun.

In the first embodiment shown in FIGS. 1 and 2, the curing fluid reservoir 8 is configured as a pressurized reservoir 8 situated on the lower side of the fluid dispensing gun in front of the trigger 6. This reservoir 8 may serve as a second handle of the fluid dispensing gun. The reservoir 8 is made of transparent material so that the curing fluid level can easily be controlled.

The curing fluid outlet 10 is designed as a spray nozzle. Depending on the movement of the fluid dispensing gun during the 1K-polyurethane application, the curing fluid outlet nozzle 10 can be turned around the dispensing tube 3 of the fluid dispensing gun.

Control means are provided for starting the curing fluid delivery when the trigger 6 of the dispensing gun is activated. These control means can be mechanical or electronic control means. When the trigger 6 is activated, the opening of the dosing nozzle 4 is preferably slightly delayed so that the surface is moistened with the curing fluid before the 1K-polyurethane foam comes out of the dosing nozzle. The curing fluid will be sprayed while dispensing the 1K-polyurethane foam. This solution allows moistening the area in which 1K-polyurethane foam is sprayed afterwards.

However, it is also possible that the curing fluid delivery starts either at the same time as the delivery of the 1K-polyurethane foam or after the delivery of the 1K-polyurethane foam. The first solution allows moistening the 1K-polyurethane foam upon leaving the outlet of the fluid dispensing gun and the second one allows moistening the already dispensed 1K-polyurethane foam.

The second embodiment of the invention shown in FIGS. 3, 4 and 5 differs from the first embodiment in that the curing fluid reservoir 8 is on the upper side of the fluid dispensing gun, just behind the means 2 for coupling a pressurized can so that the reservoir 8 and the pressurized can containing the 1-K polyurethane are one behind the other on the upper side of the fluid dispensing can.

It can be seen from the FIGS. 3, 4 and 5 that the fluid dispensing gun has an inner thread for fixing a ring onto which the curing fluid reservoir 8 is fixed by means of a second thread.

Furthermore, the curing fluid outlet 10 is shown on the upper side of the dosing nozzle 4 for the 1-K polyurethane. However, it is possible to unscrew the fixation of the curing fluid outlet 10 and to turn it by 180° around the dispensing tube 3 so that the curing fluid outlet 10 is on the lower side of the dosing nozzle 4 for the 1-K polyurethane foam. It also could be turned by another angle, e.g. by 90° in order to have the curing fluid outlet 10 at one side of the dispensing tube 3.

Instead of dispensing the curing fluid parallel to the direction of the dosing nozzle 4, it is also possible to dispense it in another direction, if suitable for the application.

The invention claimed is:

1. A fluid dispensing gun for 1K-polyurethane foam comprising a dispensing tube (3) with a dosing nozzle (4) at its outlet, a spring-loaded needle which is co-axially moveable in the dispensing tube (3) for opening and closing the dosing nozzle (4), a trigger (6) for actuating said spring-loaded needle in order to open the dosing nozzle (4) and to dispense the fluid, regulating means (7) for regulating the degree of opening of the outlet of the dosing nozzle (4) and coupling means (2) for coupling a pressurized can to the fluid dispensing gun, wherein the fluid dispensing gun comprises means (8, 9, 10) for delivering a curing fluid separately from the 1K-polyurethane foam in a direction which is essentially parallel to that of the outlet of the dosing nozzle (4) of the dispensing tube, the means (8, 9, 10) for delivering a curing fluid comprising a curing fluid reservoir (8), a curing fluid outlet (10) situated in proximity of the dosing nozzle (4) of the dispensing tube and a curing fluid line (9) connecting the curing fluid reservoir (8) and the curing fluid outlet (10), the means (8, 9, 10) for delivering a curing fluid being activated via the trigger (6) of the fluid dispensing gun.

2. The fluid dispensing gun according to claim 1, wherein the curing fluid reservoir (8) is a pressurized reservoir (8) on the fluid dispensing gun provided with a valve for delivering the curing fluid from the curing fluid reservoir (8) to the curing fluid outlet (10).

3. The fluid dispensing gun according to claim 1, wherein the curing fluid reservoir (8) is a non-pressurized reservoir (8) on the fluid dispensing gun that comprises a pump for pumping the curing fluid from the curing fluid reservoir (8) via the curing fluid line (9) to the curing fluid outlet (10).

4. The fluid dispensing gun according to claim 1, wherein the curing fluid reservoir (8) is arranged on the lower side of the fluid dispensing gun.

5. The fluid dispensing gun according to claim 1, wherein the curing fluid reservoir (8) is arranged on the upper side of the fluid dispensing gun.

6. The fluid dispensing gun according to claim 1, wherein the curing fluid reservoir (8) is at least partly transparent.

7. The fluid dispensing gun according to claim 1, wherein the curing fluid outlet (10) is designed as a spray nozzle.

8. The fluid dispensing gun according to claim 1, wherein control means are provided for starting the curing fluid delivery when the trigger (6) of the dispensing gun is activated.

9. The fluid dispensing gun according to claim 1, wherein the fluid dispensing gun has an inner thread for fixing a ring onto which the curing fluid reservoir (8) is fixed by means of a second thread.

10. A method for dispensing 1K-polyurethane foam with the fluid dispensing gun according to claim 1, wherein curing fluid is delivered from a curing fluid reservoir (8) via a separate fluid line (9) to a curing fluid outlet (10) in an essentially parallel direction of the outlet of the dosing nozzle (4) of the dispensing tube of the fluid dispensing gun upon activation of the trigger (6) of the fluid dispensing gun.

11. The method according to claim 9, wherein the curing fluid is delivered in form of a spray.

12. The method according to claim 10, wherein the curing fluid delivery starts before the delivery of the 1K-polyurethane foam.

13. The method according to claim 10, wherein the curing fluid delivery starts at the same time as the delivery of the 1K-polyurethane foam.

14. The method according to claim 10, wherein the curing fluid delivery starts after the delivery of the 1K-polyurethane foam.

* * * * *